US010273947B2

(12) United States Patent
Vehmaa

(10) Patent No.: US 10,273,947 B2
(45) Date of Patent: Apr. 30, 2019

(54) DRIVE MECHANISM, PUMP ASSEMBLY AND LUBRICATION SYSTEM

(71) Applicant: Rauno Vehmaa, Muurame (FI)

(72) Inventor: Rauno Vehmaa, Muurame (FI)

(73) Assignee: Osakeyhtiö SKF Aktiebolag, Espoo (FI)

( * ) Notice: Subject to any disclaimer, the term of this patent is extended or adjusted under 35 U.S.C. 154(b) by 321 days.

(21) Appl. No.: 15/183,227

(22) Filed: Jun. 15, 2016

(65) Prior Publication Data

US 2016/0369786 A1 Dec. 22, 2016

(30) Foreign Application Priority Data

Jun. 17, 2015 (SE) ..... 1550829

(51) Int. Cl.
*F04B 9/125* (2006.01)

(52) U.S. Cl.
CPC ..... *F04B 9/1253* (2013.01); *F04B 9/125* (2013.01)

(58) Field of Classification Search
CPC ..... F04B 2201/0201; F04B 2203/00; F04B 2203/10; F04B 2203/1001; F04B 9/10; F04B 9/103; F04B 9/105; F04B 9/1053; F04B 9/125; F04B 9/1253; F04B 49/03; F04B 49/10; F04B 9/123; F04B 9/1256; F04B 9/133; F04C 14/10; F04C 14/12; F04C 14/14; F04C 14/16; F03C 1/047; F03C 1/08; F03C 1/10; F03C 1/12; F16N 13/16; F01L 23/00; F01L 25/063; F01L 25/08; F01L 25/02; F01L 25/04; F01B 11/02; F01B 17/00; F15B 2013/0448
USPC ..... 251/65; 417/398–400, 46; 91/313
See application file for complete search history.

(56) References Cited

U.S. PATENT DOCUMENTS 97,064 A * 11/1869 Dyson ..... F01B 17/00 91/287
3,405,606 A * 10/1968 Scheffer ..... F01L 25/063 91/306
4,846,045 A * 7/1989 Grach ..... F01L 25/063 91/306

(Continued)

FOREIGN PATENT DOCUMENTS

CN 101191428 A 6/2008
CN 101680467 A 3/2010

(Continued)

*Primary Examiner* — Charles G Freay
(74) *Attorney, Agent, or Firm* — Bryan Peckjian; SKF USA Inc. Patent Dept.

(57) ABSTRACT

A drive mechanism including a pneumatic cylinder housing, a piston reciprocating in the housing between a first and second dead centers, a pumping shaft driven by the piston, a valve unit, a gas inlet, a gas outlet, the gas inlet is in fluid communication with a first chamber of the cylinder volume, and a second chamber of the cylinder volume in fluid communication with the gas outlet, when the valve unit is in a first state. The gas inlet is in fluid communication with the second chamber of the cylinder volume, and the first chamber of the cylinder volume in fluid communication with the gas outlet, when the valve unit is in a second state. The drive mechanism provides a valve unit actuator having a magnet located adjacent the valve unit and configured to alternately shift the state of the valve unit between the first state and the second state.

12 Claims, 4 Drawing Sheets

(56) References Cited

U.S. PATENT DOCUMENTS 6,129,115 A * 10/2000 Janssen ..... F15B 13/0405
137/625.65

FOREIGN PATENT DOCUMENTS

| | | | |
|---|---|---|---|
| CN | 103210219 | A | 7/2013 |
| CN | 104583655 | A | 4/2015 |
| EP | 0595116 | A1 | 5/1994 |
| WO | 2014127912 | A | 8/2014 |
| WO | 2014127912 | A2 | 8/2014 |

* cited by examiner

DRIVE MECHANISM, PUMP ASSEMBLY AND LUBRICATION SYSTEM

CROSS-REFERENCE TO RELATED APPLICATIONS

This application claims priority to Swedish patent application no. 1550829-4 filed on Jun. 17, 2015, the contents of which are fully incorporated herein by reference.

TECHNICAL FIELD OF THE INVENTION

The present invention relates generally to the field of drive mechanism for pump assemblies, wherein the drive mechanism is pneumatically driven. Further, the present invention relates specifically to the field of pump assemblies for fluid lubricants, such as grease or oil.

The present invention relates to a drive mechanism providing a pneumatic cylinder housing defining a cylinder volume that is configured to house a gas, a piston arranged in the pneumatic cylinder housing and separating the cylinder volume in a first/upper chamber and a second/lower chamber and being displaceable back and forth in the pneumatic cylinder housing between a first/upper dead center and a second/lower dead center, a pumping shaft connected to and driven by the piston, a valve unit having a first state and a second state, a gas inlet configured to be connected to a pressure source, a gas outlet configured to be connected to a pressure sink, wherein the gas inlet is in fluid communication with the upper chamber of the cylinder volume, and the lower chamber of the cylinder volume is in fluid communication with the gas outlet, when the valve unit is in the first state, and wherein the gas inlet is in fluid communication with the lower chamber of the cylinder volume, and the upper chamber of the cylinder volume is in fluid communication with the gas outlet, when the valve unit is in the second state.

The invention also relates to a pump assembly comprising a pump mechanism having a fluid lubricant inlet and a fluid lubricant outlet, and a pumping shaft configured to pump the fluid lubricant from the fluid lubricant inlet to the fluid lubricant outlet by means of a reciprocating motion, and thereto relates to a lubrication system comprising such a pump assembly, a fluid lubricant reservoir connected to the fluid lubricant inlet of the pump mechanism, and at least one lubrication point connected to the fluid lubricant outlet of the pump mechanism.

BACKGROUND OF THE INVENTION

Lubrication systems perform the task of supplying individual lubrication points or a group of lubrication points, such as at least one part of a bearing, joint, gear, and/or any other part(s) of one or more machines, with a varying or non-varying amount of liquid lubricant to ensure that the lubrication points are lubricated. Over-lubrication or under-lubrication may have negative influence on a machine component's service life and may result in machine breakdown.

In lubrication systems for instance for bearings, there is a need for supplying a fluid lubricant, such as oil or grease, to the bearings from a reservoir via pipes of the lubrication system.

Various types of pump assemblies are known for use in lubrication systems. For example, a barrel pump can be used for transporting the fluid lubricant from a reservoir to a pipe of the lubrication system. Besides supplying the fluid lubricant to a component during operation, the pump assembly can also be used when the component/bearing or bearing house is re-filled with fluid lubricant during service/installation.

International PCT-publication WO 2014/127912 describes a pump assembly for pumping a fluid lubricant. The pump assembly provides a pump mechanism configured for pumping a fluid lubricant and a drive mechanism. The drive mechanism provides a pneumatic cylinder housing configured for being powered by an air source, the pneumatic cylinder housing accommodating a movable piston for operating the pump mechanism. The drive mechanism of the pump assembly also provides an electric switch for detecting a position of the piston, an electric valve unit that is configured to shift the direction of movement of the piston upon an activation of the valve unit, and an electric control unit operatively connected to the switch and to the valve unit, wherein the control unit is configured for controlling the activation of the valve unit in response to a detection of the position of the piston by the switch.

Thus, this known pump assembly is dependent on and connected to a pressurized air source as well as a power source for the operation thereof, and the piston direction change mechanism is complex and is subject to potential malfunction due to lack of power supply to the pump assembly.

Known pump assemblies having a pneumatic drive mechanism are typically equipped with a complex direction change mechanism, for the movable piston, comprising springs which are subject for wear and will break and the pneumatic drive mechanism requires regular maintenance and regular exchange of springs in order not to jeopardize the operation of the pump assembly.

SUMMARY OF THE INVENTION

The present invention aims at obviating the aforementioned disadvantages and failings of previously known drive mechanism, and at providing an improved drive mechanism for a pump assembly. A primary object of the present invention is to provide an improved drive mechanism of the initially defined type that is only dependent on pressurized gas for the operation thereof. It is an object of the present invention to provide a drive mechanism, which provides a valve unit and valve unit actuator that are controlled in an improved manner. It is another object of the present invention to provide a drive mechanism, which provides a valve unit and valve unit actuator (piston direction change mechanism) that are mechanically operated by the actual movement of the piston of the drive mechanism. It is another object of the present invention to provide a drive mechanism, which provides less components and no control unit, and thereby is simpler in construction and entails a considerable cost reduction.

According to the invention at least the primary object is attained by means of the initially defined drive mechanism and pump assembly having the features defined in the independent claims. Preferred embodiments of the present invention are further defined in the dependent claims.

According to a first aspect of the present invention, there is provided a drive mechanism of the initially defined type, which is characterized in that the drive mechanism also provides a valve unit actuator comprising a magnet that is located adjacent the valve unit and that is configured to alternately shift the state of the valve unit between the first state and the second state, wherein the piston at the upper dead center is arranged to mechanically displace the valve unit actuator from a second/lower position to a first/upper position, the magnet shifting the valve unit from the second state to the first state, and wherein the piston at the lower dead center is arranged to mechanically displace the valve unit actuator from the upper position to the lower position, the magnet shifting the valve unit from the first state to the second state.

According to a second aspect of the present invention, there is provided a pump assembly comprising such a drive mechanism. According to a third aspect of the present invention, there is provided a lubrication system comprising such a pump assembly.

Thus, the present invention is based on the insight of having a mechanically operated valve unit and piston direction change mechanism, the drive mechanism is free from dependency of power supply thereto and a more simple drive mechanism having fewer components is provided. Thus the present invention provides a direct correlation between the movement/location of the piston and the direction of movement/displacement of the piston.

In a preferred embodiment of the present invention, the valve unit of the drive mechanism provides a valve unit housing manufactured from a non-magnetic material, and a valve body manufactured from a magnetic material and displaceable back and forth within the valve unit housing. This means that the magnet of the valve unit actuator can effect the position of the valve body located inside the valve unit housing from the outside of the valve unit body.

According to a preferred embodiment, the valve unit actuator provides a first pin extending into the upper chamber of the cylinder volume, and wherein the piston presents a first/upper surface facing the upper chamber of the cylinder volume and being configured to engage the first pin at the upper dead center of the piston. Thereby the change of the direction of movement of the piston at the upper dead center is directly affected by the piston itself.

According to a preferred embodiment, the valve unit actuator provides a second pin extending into the lower chamber of the cylinder volume, and wherein the piston presents a second/lower surface facing the lower chamber of the cylinder volume and being configured to engage the second pin at the lower dead center of the piston. Thereby the change of the direction of movement of the piston at the lower dead center is directly affected by the piston itself.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF THE INVENTION

Figure 1:
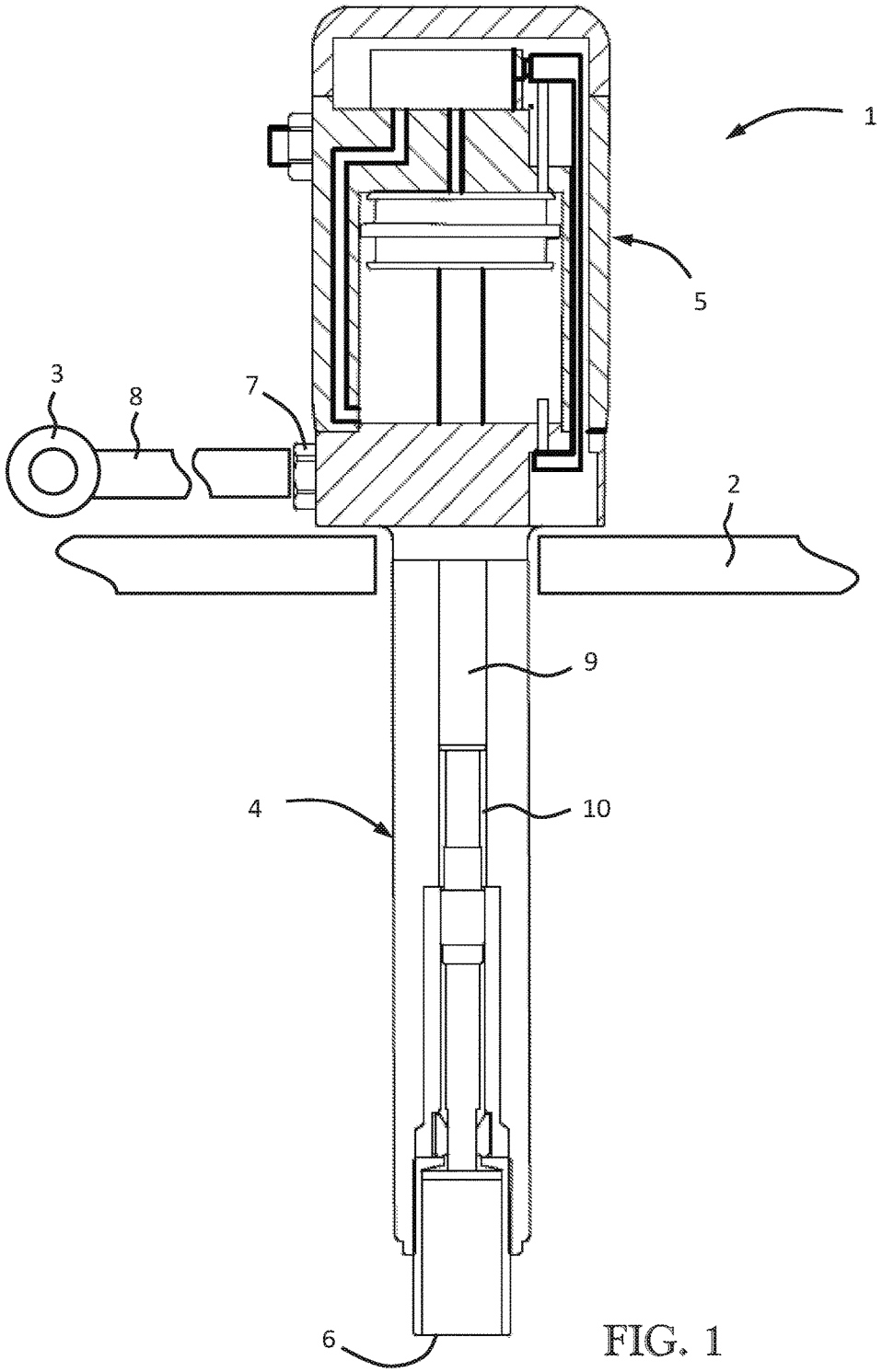
FIG. 1 is a schematic cross sectional side view of the inventive pump assembly, having the piston located in the first/upper dead center.
Figure 2:
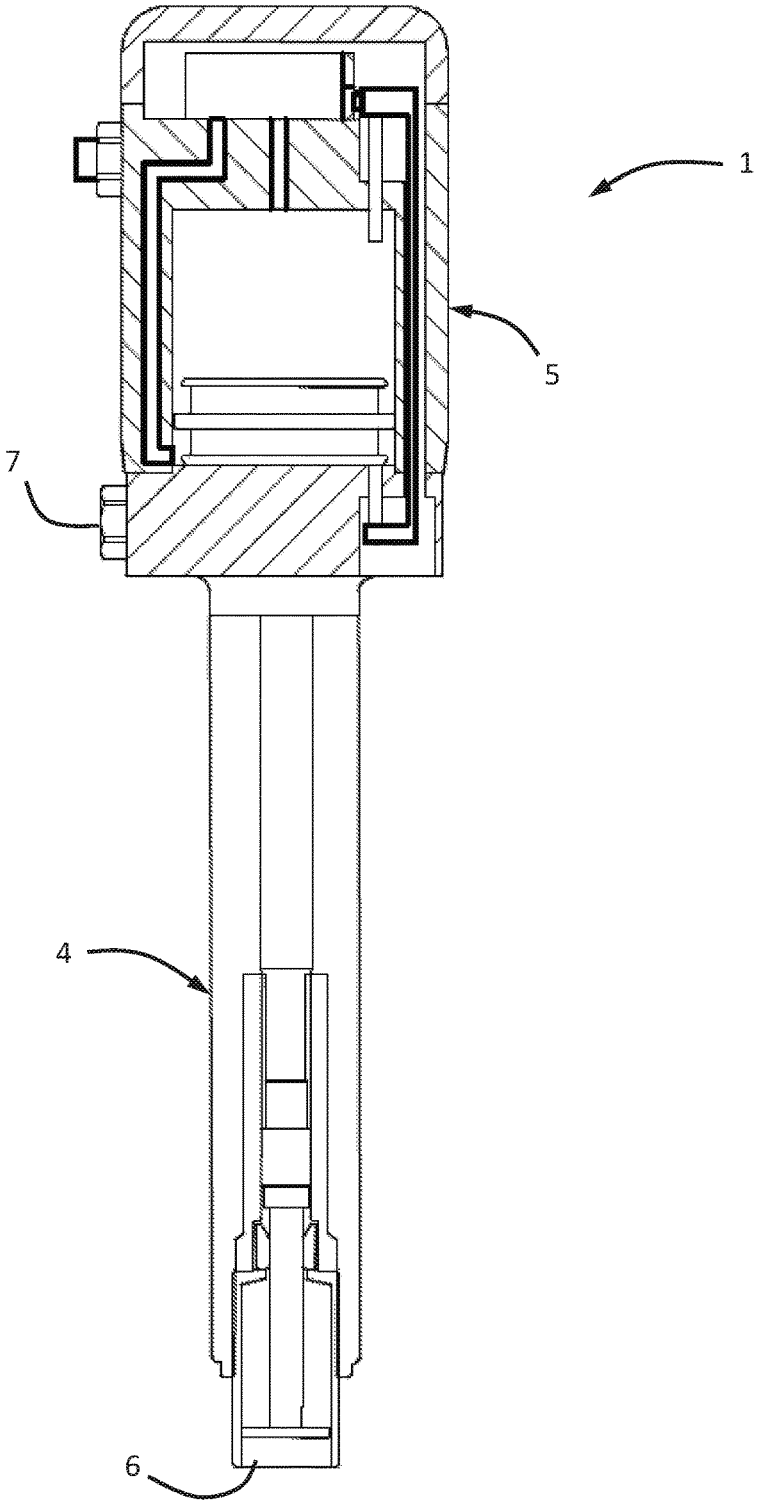
FIG. 2 is a schematic cross sectional side view of the pump assembly according to FIG. 3, having the piston located in the second/lower dead center.

Reference is initially made to FIGS. 1 and 2, disclosing an inventive pump assembly, generally designated 1, configured for pumping a fluid lubricant, for instance grease or oil. The pump assembly 1 is herein constituted by a barrel pump and the present invention will be described with reference to a barrel pump without being limited thereto.

According to a preferred embodiment, the pump assembly 1 is configured to be used in a lubrication system having a fluid lubricant reservoir 2 connected to the pump assembly 1 and at least one lubrication point 3 connected to the pump assembly 1.

The pump assembly 1 provides a pump mechanism, generally designated 4, and a drive mechanism, generally designated 5. The pump mechanism 4 provides a fluid lubricant inlet 6, that is configured to be connected to the fluid lubricant reservoir 2, and a fluid lubricant outlet 7, that is configured to be connected to the at least one lubrication point 3 via a suitable pipe/channel 8.

The pump mechanism 4 also provides a pumping shaft 9 in a conventional way configured to pump/transport the fluid lubricant from the fluid lubricant inlet 6 to the fluid lubricant outlet 7, via an internal channel 10, by means of a reciprocating motion of the pumping shaft 9. During operation the fluid lubricant inlet 6 must be submersed into the fluid lubricant that is housed in the fluid lubricant reservoir 2. The fluid lubricant outlet 7 is preferably located outside the fluid lubricant reservoir 2. The pump mechanism 4 can be either single acting, i.e. only transport fluid lubricant when the pumping shaft 9 moves up or down, or double acting, i.e. transport fluid lubricant both when the pumping shaft 9 move up and move down.

In FIG. 1 the pumping shaft 9 is in a first/upper position and in FIG. 2 the pumping shaft is in a second/lower position. The pump mechanism 4 is not described in more detail in this application.

Figure 3:
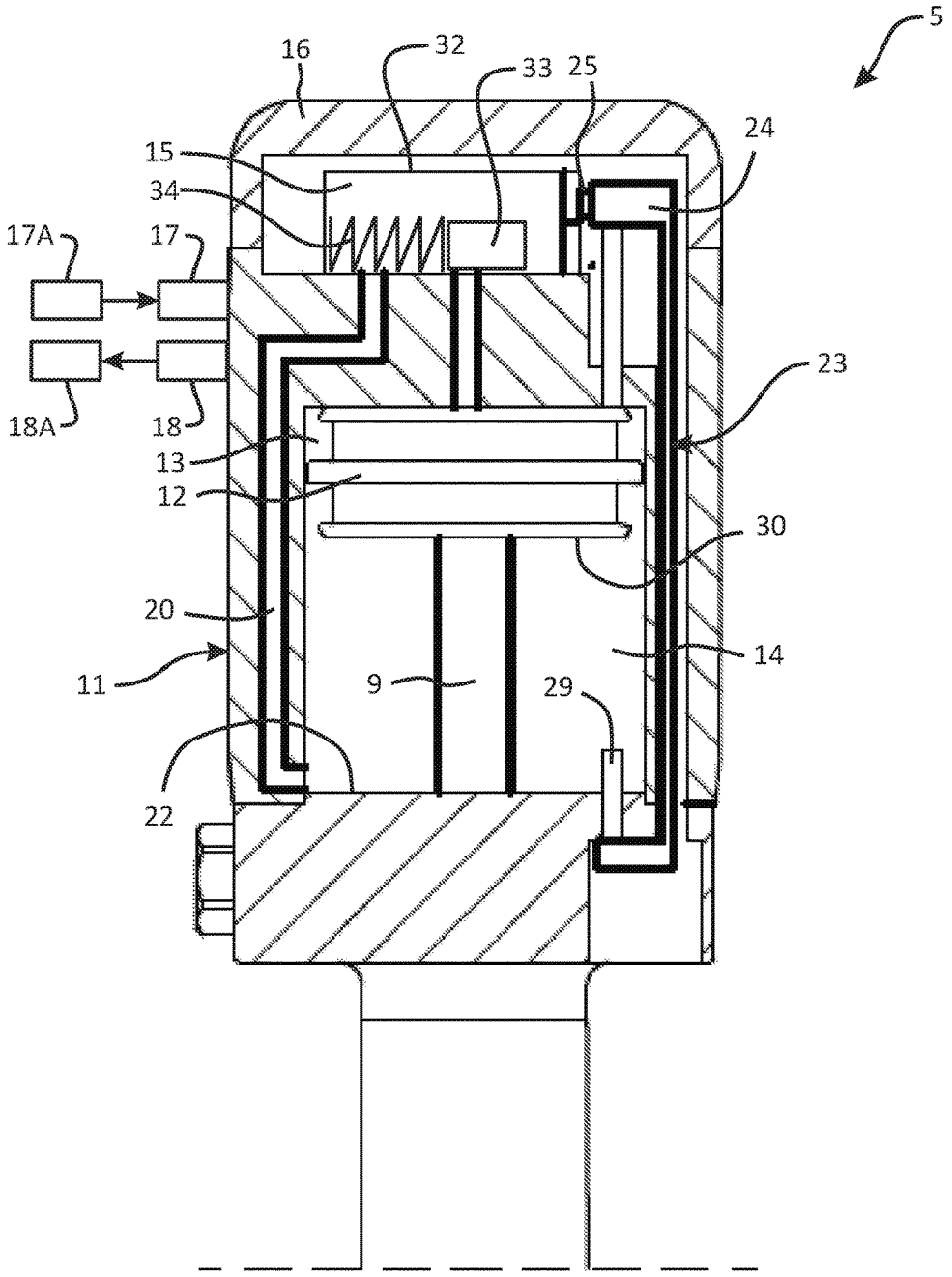
FIG. 3 is a schematic cross sectional side view of an inventive drive mechanism, having the piston located in the first/upper dead center.
Figure 4:
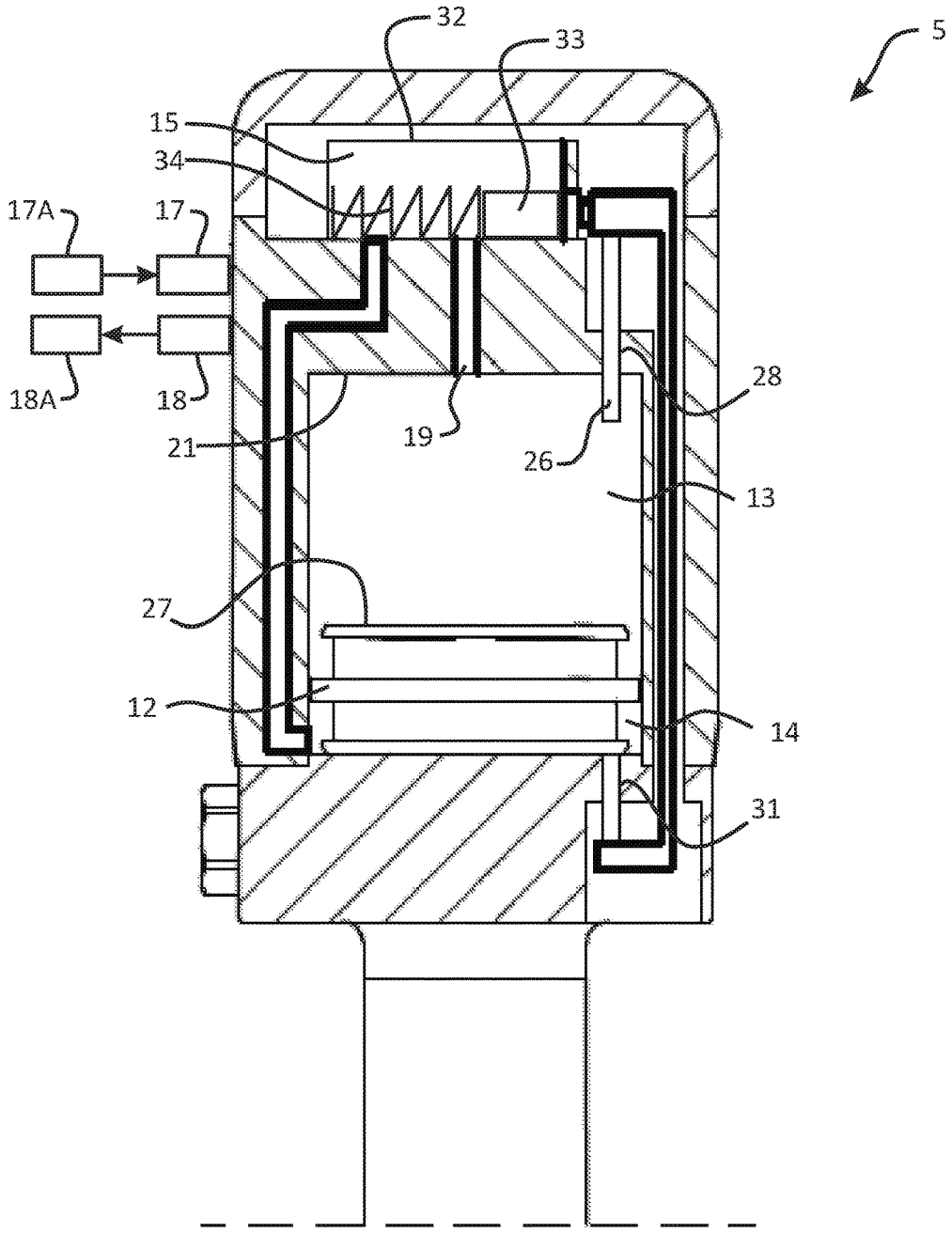
FIG. 4 is a schematic cross sectional side view of the drive mechanism according to FIG. 1, having the piston located in the second/lower dead center.

Reference is now made to FIGS. 3 and 4, disclosing the inventive drive mechanism 5 according to a preferred embodiment.

The drive mechanism 5 is configured to drive the pump mechanism 4 by providing a reciprocating motion of the pumping shaft 9. The drive mechanism 5 is pneumatically driven by means of a gas, for instance air.

The drive mechanism 5 provides a pneumatic cylinder housing 11 defining a cylinder volume 13, 14 that is configured to house the gas, and a piston 12 arranged in the pneumatic cylinder housing 11. The piston 12 is displaceable back and forth in the pneumatic cylinder housing 11 and separate the cylinder volume 13, 14 in a first/upper chamber 13 and a second/lower chamber 14. The circumference of the piston 12 is in fluid tight engagement with the inner surface of the pneumatic cylinder housing 11.

During operation of the drive mechanism 5 the piston reciprocates between a first/upper dead center, disclosed in FIG. 3 and a second/lower dead center, disclosed in FIG. 4, i.e. when the volume of the upper chamber 13 increase the volume of the lower chamber 14 decrease, and vice verse. The pumping shaft 9 is connected to and driven by the piston 12, i.e. the upper end of the pumping shaft 9 terminates in the lower chamber 14 of the cylinder volume 13, 14. Thus, the pumping shaft 9 can be considered to be part of the drive mechanism 5 as well as of the pump mechanism 4.

The drive mechanism 5 also provides a valve unit 15 that in the disclosed embodiment is connected to the pneumatic cylinder housing 11. In the preferred embodiment the drive mechanism 5 provides a cover/lid 16 connected to the pneumatic cylinder housing 11 and protecting the valve unit 15. The cover 16 may be connected to the pneumatic cylinder housing 11 by means of one or more screws (not shown). The valve unit 15 is preferably constituted by a solenoid valve, and most preferably by a so-called 5/2 solenoid valve. The valve unit 15 has at least a first state and a second state.

Preferably the valve unit 15 provides a valve unit housing 32 manufactured from a non-magnetic material, and a valve body 33 manufactured from a magnetic material, wherein the valve body 33 is displaceable back and forth within the valve unit housing 32, between a first position and a second position. According to a preferred embodiment the valve body 33 is biased towards the first position by means of a spring means 34, the valve unit 15 being in the first state.

The drive mechanism 5 provides a gas inlet 17 that is configured to be connected to a pressure source 17A, and a gas outlet 18 that is configured to be connected to a pressure sink 18A. The pressure source 17A is preferably constituted by a gas compressor or gas pump, and the pressure sink 18A is preferably constituted by the ambient air. The pressure of the pressurized gas is preferably in the range up to 10 bar. The flow rate from the pressure source 17A is preferably in the range up to 700 liters/minute.

The gas inlet 17 is in fluid communication with the valve unit 15, and the gas outlet 18 is in fluid communication with the valve unit 15. Thereto a first channel 19 extend between the valve unit 15 and the upper chamber 13 of the cylinder volume 13, 14, and a second channel 20 extend between the valve unit 15 and the lower chamber 14 of the cylinder volume 13, 14.

Thereby, when the valve unit 15 is in the first state the gas inlet 17 is in fluid communication with the upper chamber 13 of the cylinder volume 13, 14, and the lower chamber 14 of the cylinder volume 13, 14 is in fluid communication with the gas outlet 18, and when the valve unit 15 is in the second state the gas inlet 17 is in fluid communication with the lower chamber 14 of the cylinder volume 13, 14, and the upper chamber 13 of the cylinder volume 13, 14 is in fluid communication with the gas outlet 18.

During operation of the drive mechanism 5, i.e. when pressurized gas is supplied to the gas inlet 17, and given that the valve unit 15 is in the first state, the pressure in the upper chamber 13 of the cylinder volume 13, 14 is higher than the pressure in the lower chamber 14 of the cylinder volume 13, 14 and the piston 12 is consequently displaced downwards in the direction from the upper dead center towards the lower dead center. Correspondingly, given that the valve unit 15 is in the second state, the pressure in the lower chamber 14 of the cylinder volume 13, 14 is higher than the pressure in the upper chamber 13 of the cylinder volume 13, 14 and the piston 12 is consequently displaced upwards in the direction from the lower dead center towards the upper dead center.

It is realized that it is necessary for the piston 12 to change direction of displacement between upwards movement/displacement and downwards movement/displacement in order to generate a reciprocating motion of the pumping shaft 9. The change of direction takes place at the upper dead center of the piston 12 and at the lower dead center of the piston 12, respectively, and in order to maximize the length of stroke of the piston 12 and of pumping shaft 9 the upper dead center of the piston 12 is arranged to be located at a first/upper end surface 21 of the pneumatic cylinder housing 11 and the lower dead center of the piston 12 is arranged to be located at a second/lower end surface 22 of the pneumatic cylinder housing 11. The distance between the upper end surface 21 and the lower end surface 22 is in the range 5-15 centimeters.

In order for the piston 12 to change direction of displacement it is essential for the present invention that the drive mechanism 5 provides a valve unit actuator, generally designated 23.

The valve unit actuator 23 provides a body 24 and a magnet 25 connected to the body 24. The magnet 25 is located adjacent the valve unit 15 and is configured to alternately shift the state of the valve unit 15 between the first state and the second state. That is, the magnet 25, due to its magnetic force, effect the movable valve body 33 of the valve unit 15 to move within the valve unit housing 32 between the first position and the second position.

The valve unit actuator 23 is displaceable between a first/upper position, in which the magnet 25 has moved the valve body 33 of the valve unit 15 to the first position and shifted the valve unit 15 from the second state to the first state, and a second/lower position, in which the magnet 25 has moved the valve body 33 of the valve unit 15 to the second position and shifted the valve unit 15 from the first state to the second state. The distance between the first position and the second position of the valve unit actuator 23 is in the range 4-10 millimeters.

It is essential for the present invention that the piston 12 at the upper dead center is arranged to mechanically displace the valve unit actuator 23 from the lower position to the upper position, and at the lower dead center is arranged to mechanically displace the valve unit actuator 23 from the upper position to the lower position. Thus, the present invention provides a direct correlation between the position of the piston 12 and the direction of movement of the piston 12.

According to the preferred embodiment the valve unit actuator 23 provides a first pin 26 extending into the upper chamber 13 of the cylinder volume 13, 14. The piston 12 having a first surface 27 facing the upper chamber 13 of the cylinder volume 13, 14 and being configured to engage the first pin 26 at the upper dead center of the piston 12. The first pin 26 is connected to or part of the body 24 of the valve unit actuator 23.

In a preferred embodiment the first surface 27 of the piston 12 abut a first stop surface of the pneumatic cylinder housing 11 when the piston 12 is located in the first dead center. In the shown embodiment the first stop surface is constituted by the first/upper end surface 21 of the pneumatic cylinder housing 11. The first pin 26 extend through a hole 28 in the upper end surface 21 of the pneumatic cylinder housing 11, the interface between the hole 28 and the first pin 26 being fluid tight.

According to the preferred embodiment the valve unit actuator 23 provides a second pin 29 extending into the lower chamber 14 of the cylinder volume 13, 14. The piston 12 having a second surface 30 facing the lower chamber 14 of the cylinder volume 13, 14 and being configured to engage the second pin 29 at the lower dead center of the piston 12. The second pin 29 is connected to or part of the body 24 of the valve unit actuator 23.

In a preferred embodiment the second surface 30 of the piston 12 abut a second stop surface of the pneumatic cylinder housing 11 when the piston 12 is located in the lower dead center. In the shown embodiment the second stop surface is constituted by the second/lower end surface 22 of the pneumatic cylinder housing 11. The second pin 29 extend through a hole 31 in the lower end surface 22 of the pneumatic cylinder housing 11, the interface between the hole 31 and the second pin 29 being fluid tight.

The valve unit actuator 23 is kept in the first position, when the piston 12 is displaced downwards and before engaging the second pin 29, by means of friction and by means of the pressure that is present in the upper chamber 13 of the cylinder volume 13, 14 and that act against the end of the first pin 26.

According to the present invention the valve unit actuator 23 does not need any springs or the like which are subject to possible malfunction.

FEASIBLE MODIFICATIONS OF THE INVENTION

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A drive mechanism for a pump assembly, the drive mechanism being configured for providing a reciprocating motion of a pumping shaft, the drive mechanism comprising:

a pneumatic cylinder housing defining a cylinder volume that is configured to house a gas, a piston arranged in the pneumatic cylinder housing, separating the cylinder volume in a first chamber and a second chamber, and being displaceable back and forth in the pneumatic cylinder housing between a first dead centre and a second dead centre, a pumping shaft connected to and driven by the piston, a valve unit having a first state and a second state, a gas inlet configured to be connected to a pressure source, a gas outlet configured to be connected to a pressure sink, wherein the gas inlet is in fluid communication with the first chamber of the cylinder volume, and the second chamber of the cylinder volume is in fluid communication with the gas outlet, when the valve unit is in the first state, wherein the gas inlet is in fluid communication with the second chamber of the cylinder volume, and the first chamber of the cylinder volume is in fluid communication with the gas outlet, when the valve unit is in the second state, wherein the drive mechanism further comprises:

a valve unit actuator having a magnet that is located adjacent the valve unit and that is configured to alternately shift the state of the valve unit between the first state and the second state, wherein the piston at the first dead centre is arranged to mechanically displace the valve unit actuator from a second position to a first position, the magnet shifting the valve unit from the second state to the first state, and wherein the piston at the second dead centre is arranged to mechanically displace the valve unit actuator from the first position to the second position, the magnet shifting the valve unit from the first state to the second state, and wherein the valve unit is shifted in a direction perpendicular to the movement of the valve unit actuator.

2. The drive mechanism according to claim 1, wherein the valve unit further comprises a valve unit housing manufactured from a non-magnetic material, and a valve body manufactured from a magnetic material and displaceable back and forth within the valve unit housing.

3. The drive mechanism according to claim 2, wherein the valve body is actuated by means of the magnet of the valve unit actuator.

4. The drive mechanism according to claim 2, wherein the valve body is biased towards a first position by means of a spring means, the valve unit being in the first state.

5. The drive mechanism according to claim 1, wherein the valve unit actuator further comprises a first pin extending into the first chamber of the cylinder volume, and wherein the piston presents a first surface facing the first chamber of the cylinder volume and being configured to engage the first pin at the first dead center of the piston.

6. The drive mechanism according to claim 5, wherein the first surface of the piston abuts a first stop surface of the pneumatic cylinder housing when the piston is located in the first dead centre.

7. The drive mechanism according to claim 1, wherein the valve unit actuator further comprises a second pin extending into the second chamber of the cylinder volume, and wherein the piston presents a second surface facing the second chamber of the cylinder volume and being configured to engage the second pin at the second dead center of the piston.

8. The drive mechanism according to claim 7, wherein the second surface of the piston abuts a second stop surface of the pneumatic cylinder housing when the piston is located in the second dead centre.

9. The drive mechanism according to claim 1, wherein the pressure source is a gas compressor.

10. The drive mechanism according to claim 1, wherein the pressure sink is the ambient air.

11. A pump assembly for pumping a fluid lubricant, the pump assembly comprising:

a pump mechanism having a fluid lubricant inlet, a fluid lubricant outlet, and a pumping shaft configured to pump the fluid lubricant from the fluid lubricant inlet to the fluid lubricant outlet by means of a reciprocating motion, wherein the pump assembly further comprises a drive mechanism having;

a pneumatic cylinder housing defining a cylinder volume that is configured to house a gas, a piston arranged in the pneumatic cylinder housing, separating the cylinder volume in a first chamber and a second chamber, and being displaceable back and forth in the pneumatic cylinder housing between a first dead center and a second dead center, a valve unit having a first state and a second state, a gas inlet configured to be connected to a pressure source, a gas outlet configured to be connected to a pressure sink, wherein the gas inlet is in fluid communication with the first chamber of the cylinder volume, and the second chamber of the cylinder volume is in fluid communication with the gas outlet, when the valve unit is in the first state, wherein the gas inlet is in fluid communication with the second chamber of the cylinder volume, and the first chamber of the cylinder volume is in fluid communication with the gas outlet, when the valve unit is in the second state, wherein the drive mechanism further comprises:

a valve unit actuator having a magnet that is located adjacent the valve unit and that is configured to alternately shift the state of the valve unit between the first state and the second state, wherein the piston at the first dead center is arranged to mechanically displace the valve unit actuator from a second position to a first position, the magnet shifting the valve unit from the second state to the first state, and wherein the piston at the second dead center is arranged to mechanically displace the valve unit actuator from the first position to the second position, the magnet shifting the valve unit from the first state to the second state, and wherein the valve unit is shifted in a direction perpendicular to the movement of the valve unit actuator.

12. A lubrication system comprising:

the pump assembly according to claim 11, a fluid lubricant reservoir connected to the fluid lubricant inlet of the pump mechanism, and at least one lubrication point connected to the fluid lubricant outlet of the pump mechanism.

* * * * *